US008059084B2

(12) United States Patent
Kim et al.

(10) Patent No.: US 8,059,084 B2
(45) Date of Patent: Nov. 15, 2011

(54) APPARATUS USING AMBIENT LIGHT AS BACKLIGHT AND METHOD FOR CORRECTING COLORS THEREIN

(75) Inventors: Kyong-wook Kim, Suwon-si (KR); Moon-cheol Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1280 days.

(21) Appl. No.: 11/717,640

(22) Filed: Mar. 14, 2007

(65) Prior Publication Data

US 2007/0216622 A1 Sep. 20, 2007

(30) Foreign Application Priority Data

Mar. 14, 2006 (KR) ..... 10-2006-0023571

(51) Int. Cl.
*G09G 3/36* (2006.01)

(52) U.S. Cl. ..... 345/102; 345/87

(58) Field of Classification Search ..... 345/87–111
See application file for complete search history.

(56) References Cited

U.S. PATENT DOCUMENTS 6,999,617 B1 * 2/2006 Ohga ..... 382/167
7,468,721 B2 * 12/2008 Nakano ..... 345/102
2003/0210221 A1 * 11/2003 Aleksic ..... 345/102

* cited by examiner

*Primary Examiner* — Srilakshmi K Kumar
(74) *Attorney, Agent, or Firm* — Sughrue Mion, PLLC

(57) ABSTRACT

Provided are an apparatus using ambient light as backlight and a method for correcting colors in the apparatus. The apparatus includes a color correction matrix generator and a color corrector. The color correction matrix generator generates a first color correction matrix for correcting a second color conversion matrix when ambient light is used as backlight into a third color conversion matrix for the original backlight. The color corrector corrects colors using the first color correction matrix.

17 Claims, 6 Drawing Sheets

APPARATUS USING AMBIENT LIGHT AS BACKLIGHT AND METHOD FOR CORRECTING COLORS THEREIN

CROSS-REFERENCE TO RELATED PATENT APPLICATION

This application claims priority from Korean Patent Application No. 10-2006-0023571, filed on Mar. 14, 2006 in the Korean Intellectual Property Office, the disclosure of which is incorporated herein in its entirety by reference.

BACKGROUND OF THE INVENTION

1. Field of the Invention

The present invention relates to an apparatus using ambient light as backlight and a method for correcting colors in the apparatus, and more particularly, to an apparatus and method for correcting color distortion generated when ambient light is varied and the ambient light is used as backlight.

2. Description of the Related Art

Portable devices such as personal data assistants (PDAs), portable media players (PMPs) and notebook computers are used in places where there is ambient light, for example, sunlight or artificial light. Users sometimes use these portable devices in places where ambient light is brighter than backlight. Bright ambient light deteriorates visibility of the display of the portable devices and generates color distortion to decrease picture quality. The performance of backlight for correcting these problems is restricted and the performance of a battery is also limited. Accordingly, sufficient picture quality cannot be secured and the portable devices cannot be used for a long time in environments such as the open air where ambient light exists.

To solve this problem, there have been proposed techniques that use ambient light as backlight to increase visibility of display when natural light such as sunlight and external light such as artificial light are sufficiently bright. These techniques do not use backlight or less use backlight to extend battery consumption time when the ambient light is used as the backlight. However, even these techniques cause color distortion because the quantity of light or color temperature of light is changed due to a variation in the weather, a lapse of time, a change of the place where a portable device is used, a variation in surrounding light and/or objects or people around the portable device.

SUMMARY OF THE INVENTION

The present invention provides an apparatus using ambient light as backlight and a method for correcting colors in the apparatus, which correct color distortion due to a variation in ambient light input to a portable device to represent right colors.

According to an aspect of the present invention, there is provided an apparatus using ambient light as backlight comprising: a color correction matrix generator generating a color correction matrix Mc for correcting a color conversion matrix M' when the ambient light is used as backlight into a color conversion matrix M for the original backlight; and a color corrector correcting colors using the color correction matrix Mc. The color conversion matrixes M' and M convert an RGB color space into an XYZ color space, and the color conversion matrix M is a matrix when the ambient light is not used as the backlight.

The color correction matrix generator may comprise: an ambient light sensor sensing the ambient light; an analog-to-digital converter converting the sensed ambient light into a digital signal; a spectrum estimator estimating the spectrum distribution of the ambient light using the digital signal; and a color correction matrix calculator calculating a color conversion matrix $M_{AMBIENT}$ for the ambient light for converting the RGB space for the ambient light into an XYZ color space using the estimated spectrum distribution and calculating the color correction matrix Mc using the color conversion matrix $M_{AMBIENT}$ and the color conversion matrix M.

The color correction matrix calculator may add the color conversion matrix M to the color conversion matrix $M_{AMBIENT}$ to obtain the color conversion matrix M' and multiply the color conversion matrix M by the inverse matrix $M'^{-1}$ of the color conversion matrix M' to obtain the color correction matrix Mc.

The color conversion matrix M for the original backlight may be stored as a predetermined value.

The color corrector may multiply the color correction matrix Mc by linear RGB signals to generate corrected RGB signals.

The ambient light sensor may include at least two sensors and convert the sensed ambient light into XYZ signals when any of the sensors is not an XYZ sensor.

The apparatus may further comprise: a de-gamma unit receiving nonlinear RGB signals and converting the nonlinear RGB signals into linear RGB signals; a gamma unit gamma-correcting the corrected RGB signals output from the color corrector; and a display unit displaying the gamma-corrected RGB signals.

The apparatus may further comprise a broadcasting signal processor processing a received broadcasting signal to generate the nonlinear RGB signals.

According to another aspect of the present invention, there is provided a method for correcting colors in an apparatus using ambient light as backlight comprising: generating a color correction matrix Mc for correcting a color conversion matrix M' when the ambient light is used as backlight into a color conversion matrix M for the original backlight; and correcting colors using the color correction matrix Mc. The color conversion matrixes M' and M convert an RGB color space into an XYZ color space, and the color conversion matrix M is a matrix when the ambient light is not used as the backlight.

BRIEF DESCRIPTION OF THE DRAWINGS

The above and other aspects of the present invention will become more apparent by describing in detail exemplary embodiments thereof with reference to the attached drawings in which.

DETAILED DESCRIPTION OF EXEMPLARY EMBODIMENTS OF THE INVENTION

Figure 1A:
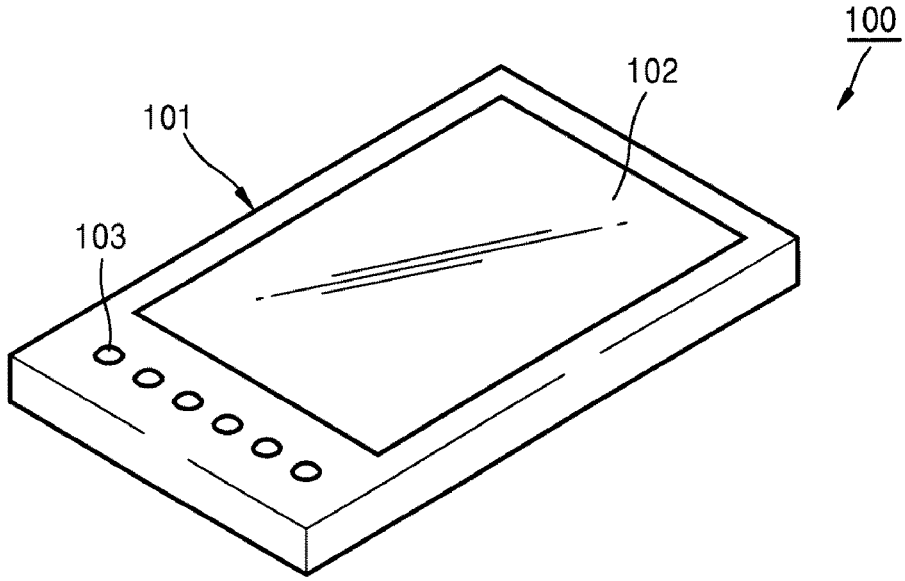
FIGS. 1A and 1B illustrate the external appearance of an apparatus using ambient light as backlight according to an exemplary embodiment of the present invention.

The present invention will now be described more fully with reference to the accompanying drawings, in which exemplary embodiments of the invention are shown. The invention may, however, be embodied in many different forms and should not be construed as being limited to the exemplary embodiments set forth herein; rather, these embodiments are provided so that this disclosure will be thorough and complete, and will fully convey the concept of the invention to those skilled in the art. Throughout the drawings, like reference numerals refer to like elements.

Figure 1B:
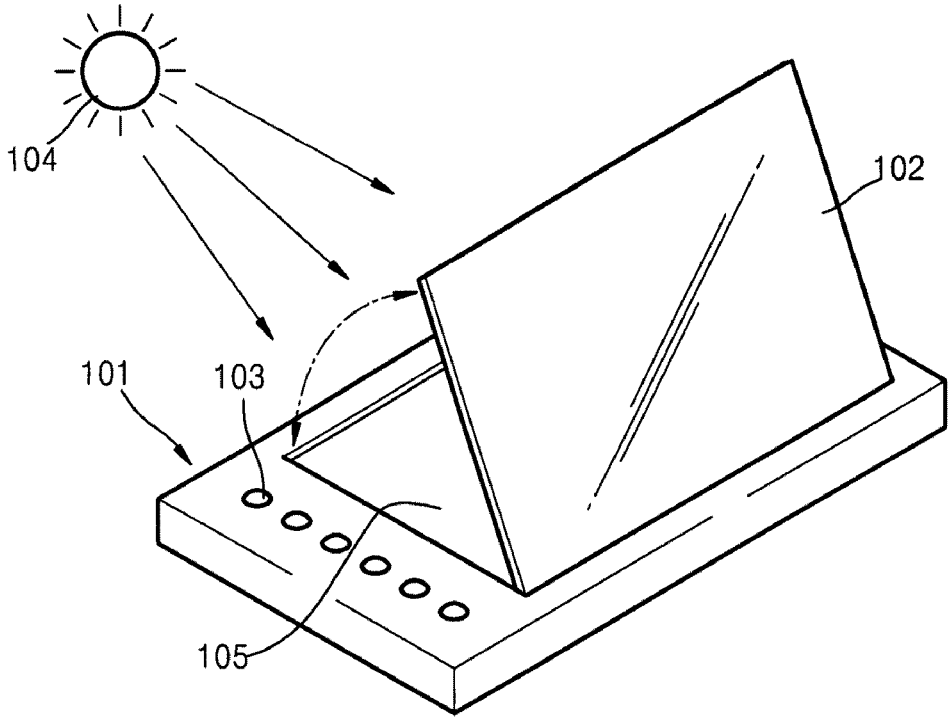

FIGS. 1A and 1B illustrate the external appearance of an apparatus 100 using ambient light as backlight according to an exemplary embodiment of the present invention. Referring to FIG. 1A, the apparatus 100 includes a main body 101, a display panel 102 and a user input receiver 103 for receiving a user input. Referring to FIG. 1B, the main body 101 and the panel 102 can be separated from each other in such a manner that one side of the panel 102 is lifted while the other side is hingedly fixed to the main body 101.

The apparatus 100 displays images using its backlight as does a general portable display device after sunset or in a dark place where ambient light is dim, as illustrated in FIG. 1A. In a place where ambient light 104 is sufficiently bright, the apparatus 100 displays images using the ambient light 104 instead of its backlight or using both the ambient light 104 and its backlight, as illustrated in FIG. 1B. The ambient light 104 is reflected by a reflecting plate 105 and input to the panel 102 to serve as the backlight. According to this construction, the apparatus 100 uses the ambient light brighter than the backlight as the backlight to improve visibility in an environment where the ambient light is bright.

However, when the quantity of light is changed or color temperature of light is varied due to a variation in the weather, the lapse of time, change of place where the apparatus is used, change of surrounding light, and objects or people around the apparatus, the ambient light is not uniformly input to the panel. This generates color distortion. Accordingly, it is necessary to correct the color distortion.

Figure 2:
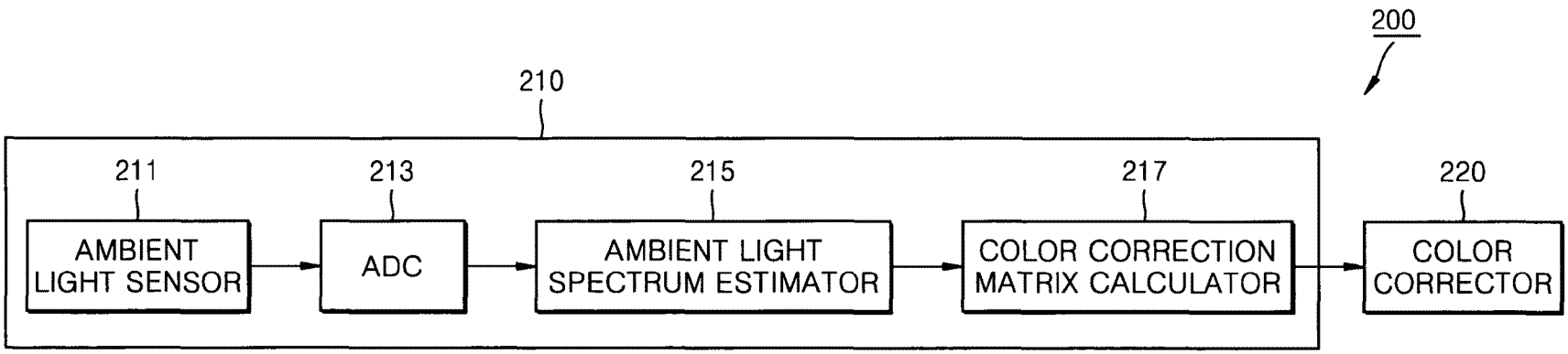
FIG. 2 is a block diagram of an apparatus using ambient light as backlight according to an exemplary embodiment of the present invention.

FIG. 2 is a block diagram of an apparatus 200 using ambient light as backlight according to an exemplary embodiment of the present invention. Referring to FIG. 2, the apparatus 200 includes a color correction matrix generator 210 and a color corrector 220 for correcting colors using a color correction matrix generated by the color correction matrix generator 210.

The color correction matrix generator 210 generates a color correction matrix Mc for correcting a color conversion matrix M' when ambient light is used as backlight into a color conversion matrix M for original backlight. The color conversion matrix means a matrix for converting an RGB color space into an XYZ color space in this specification. The color conversion matrix M for the original backlight means a color conversion matrix when the ambient light is not used as the backlight.

Specifically, the color correction matrix generator 210 generates the color correction matrix Mc using a color conversion matrix $M_{AMBIENT}$ for ambient light, which converts the RGB color space of the ambient light into an XYZ color space and the color conversion matrix M for the original backlight.

A method of generating the color correction matrix will now be explained in detail.

The relationship between CIE 3 pole values X, Y and Z and monitor linear RGB in a general display device is as follows.

$$\begin{pmatrix} X \\ Y \\ Z \end{pmatrix} = M \cdot \begin{pmatrix} R \\ G \\ B \end{pmatrix} \quad \text{[Equation 1]}$$

The color conversion matrix M for the original backlight is a 3×3 matrix and it is determined by characteristics of the display device. When the ambient light used as backlight is changed, the matrix M is varied to result in different XYZ values for the same RGB values, generating color distortion. This is represented as follows.

$$\begin{pmatrix} X' \\ Y' \\ Z' \end{pmatrix} = M' \cdot \begin{pmatrix} R \\ G \\ B \end{pmatrix} \quad \text{[Equation 2]}$$

Here, M' represents the color conversion matrix when the ambient light is used as the backlight or the ambient light used as the backlight is changed. The matrix M' is obtained by adding the color conversion matrix M to the color conversion matrix $M_{AMBIENT}$ for ambient light when the ambient light and the backlight are used together, which is represented as follows.

$$M' = M + M_{AMBIENT} \quad \text{[Equation 3]}$$

When the original backlight is turned off and the ambient light is used as the backlight, the matrix M' becomes the color conversion matrix $M_{AMBIENT}$, as represented by Equation 4.

$$M' = M_{AMBIENT} \quad \text{[Equation 4]}$$

To obtain the same XYZ values for the same RGB values even when the ambient light is changed, M' is multiplied by $M'^{-1}M$. When RGB signals are multiplied by $M'^{-1}M$ before the RGB signals are transmitted to the display device and then transmitted to the display device, X1=X, Y1=Y and Z1=Z, which is represented as follows.

$$\begin{pmatrix} X' \\ Y' \\ Z' \end{pmatrix} = M' M'^{-1} M \cdot \begin{pmatrix} R \\ G \\ B \end{pmatrix} \quad \text{[Equation 5]}$$

Equation 1 and Equation 5 can be rearranged into Equation 6.

$$\begin{pmatrix} R \\ G \\ B \end{pmatrix} \Rightarrow M'^{-1} M \cdot \begin{pmatrix} R \\ G \\ B \end{pmatrix} \quad \text{[Equation 6]}$$

Since M is known, the color conversion matrix M' reflecting the characteristic of the ambient light is obtained and then RGB values are multiplied by $M'^{-1}M$ and transmitted to the display device to correct color distortion when the ambient light has been changed.

As represented by Equations 3 and 4, to obtain the color conversion matrix M', the color conversion matrix $M_{AMBIENT}$ for the ambient light should be calculated. $M_{AMBIENT}$ can be calculated by Equation 7.

$$M_{AMBIENT} = \begin{pmatrix} X_R & X_G & X_B \\ Y_R & Y_G & Y_B \\ Z_R & Z_G & Z_B \end{pmatrix} = \int S(\lambda) \cdot \begin{pmatrix} \bar{x}(\lambda) \\ \bar{y}(\lambda) \\ \bar{z}(\lambda) \end{pmatrix} \cdot (\tau_R(\lambda)\tau_G(\lambda)\tau_B(\lambda))d\lambda \quad \text{[Equation 7]}$$

Here, $S(\lambda)$ is a function representing the spectrum distribution of the ambient light, $\bar{x}(\lambda)$, $\bar{y}(\lambda)$ and $\bar{z}(\lambda)$ are color matching functions and $\tau_R(\lambda)$, $\tau_G(\lambda)$ and $\tau_B(\lambda)$ are channel spectral transmittance of the display panel.

The spectrum distribution of the ambient light can be estimated as follows.

When the ambient light is sensed and X, Y and Z are determined, color coordinates and color temperature can be obtained. When the color temperature of the ambient light is known, the spectrum distribution of the ambient light can be estimated to obtain $S(\lambda)$.

Figure 4:
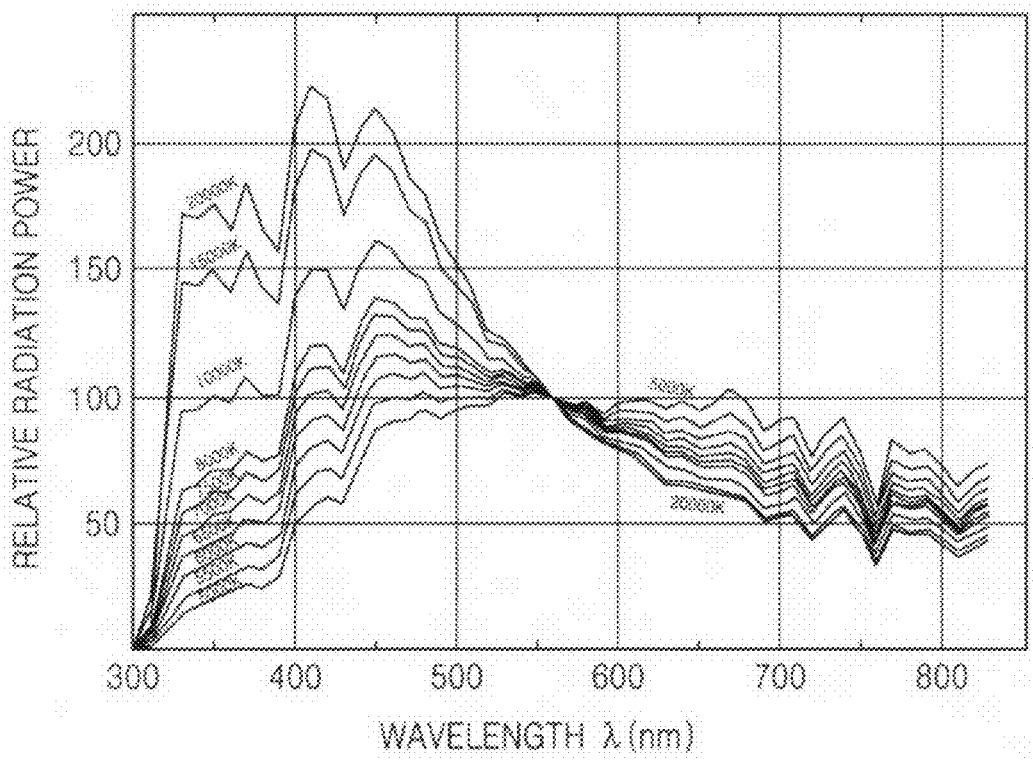
FIG. 4 illustrates the spectrum distribution of sunlight.

FIG. 4 illustrates the spectrum distribution of sunlight. When the ambient light is sunlight, the spectrum distribution of the ambient light can be estimated using the spectrum distribution of FIG. 4. Furthermore, the spectrum distribution of other ambient lights such as indoor light can be estimated using a similar method.

Figure 5:
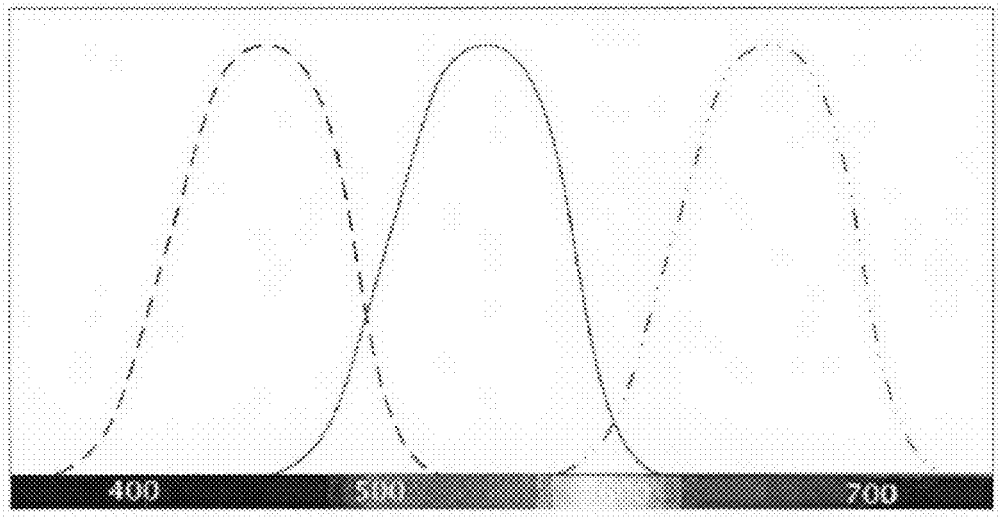
FIG. 5 illustrates channel spectral transmittance.
Figure 6:
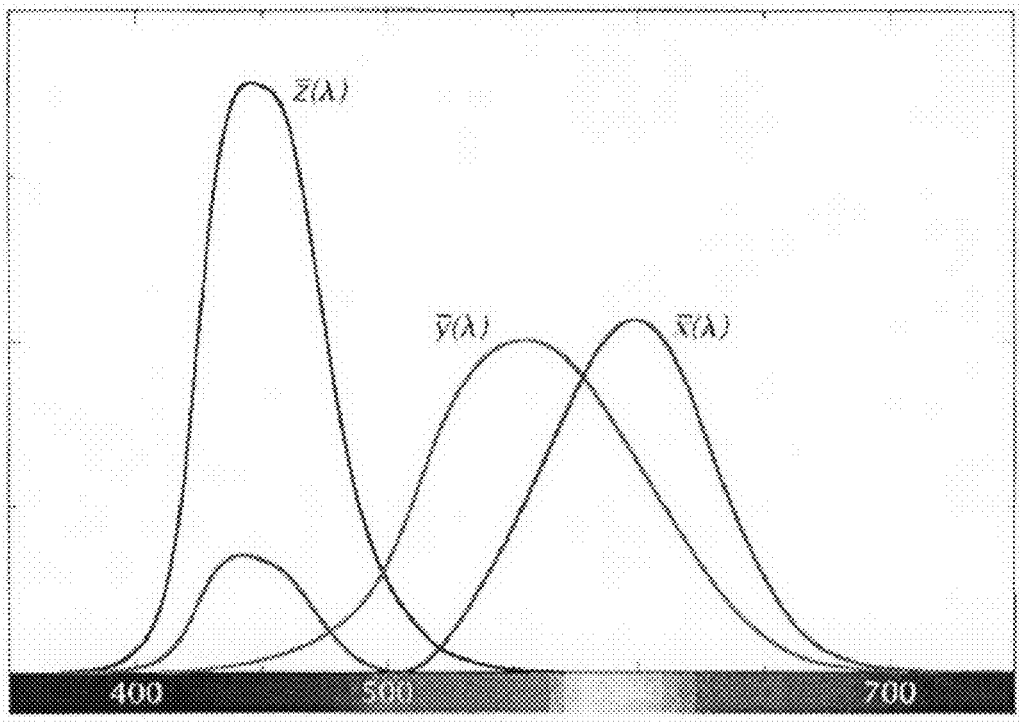
FIG. 6 illustrates color matching functions.

The channel spectral transmittance illustrated in FIG. 5 is determined by the characteristic of the display device and the color matching functions as illustrated in FIG. 6 are values that CIE determines. Thus, $M_{AMBIENT}$ can be known using Equation 7. In addition, M' can be calculated using Equations 3 and 4. Furthermore, RGB values are multiplied by $M'^{-1}M$ and transmitted to the display device to correct color distortion.

The color correction matrix generator 210 for generating the aforementioned color correction matrix is explained in more detail with reference to FIG. 2. The color correction matrix generator 210 includes an ambient light sensor 211, an analog-to-digital converter 213, an ambient light spectrum estimator 215 and a color correction matrix calculator 217.

The ambient light sensor 211 senses ambient light existing around the apparatus using the ambient light as backlight and transmits the sensed ambient light to the analog-to-digital converter 213. The ambient light sensor 211 can include at least two sensors. The ambient light sensor 211 converts the sensed ambient light into XYZ signals when sensing the ambient light with sensors other than an XYZ sensor, for example, an RGB sensor.

The analog-to-digital converter 213 converts the ambient light transmitted from the ambient light sensor 211 into a digital signal. The ambient light spectrum estimator 215 estimates the spectrum distribution of the ambient light using the digital signal. The ambient light spectrum estimator 215 previously stores data about spectrum distribution required for estimating the spectrum of the ambient light, and thus the spectrum distribution in response to the type of the ambient light can be estimated. For example, data about spectrum distributions in response to types of lights used as ambient light can be previously stored in the ambient light spectrum estimator 215 in a room.

The color correction matrix calculator 217 calculates the color conversion matrix $M_{AMBIENT}$ for the ambient light according to Equation 7 using the previously stored color matching functions, the channel spectral transmittance in response to the characteristic of the display device, and the spectrum distribution estimated by the ambient light spectrum estimator 215. Then, the color correction matrix calculator 217 calculates the color correction matrix Mc using the color conversion matrix $M_{AMBIENT}$ and the color conversion matrix M for the original backlight.

Specifically, the color correction matrix calculator 217 adds the color conversion matrix M to the color conversion matrix $M_{AMBIENT}$ to obtain the color conversion matrix M'. When the original backlight is turned off and only the ambient light is used as backlight, the color conversion matrix $M_{AMBIENT}$ will become the color conversion matrix M', as represented by Equation 4. The color correction matrix calculator 217 multiplies the color conversion matrix M by the inverse matrix $M'^{-1}$ of the color correction matrix M' to obtain the color correction matrix Mc. The color conversion matrix M can be stored as a predetermined value in the color correction matrix calculator 217.

The color corrector 220 receives linear RGB signals and multiplies the received linear RGB signals by the color correction matrix Mc to generate corrected RGB signals, thereby correcting colors. The corrected RGB signals are transmitted to an output unit (not shown). The RGB signals can be generated in a manner that data stored in a storage medium is processed or a broadcasting signal is processed and inputted to the color corrector 220.

Figure 3:
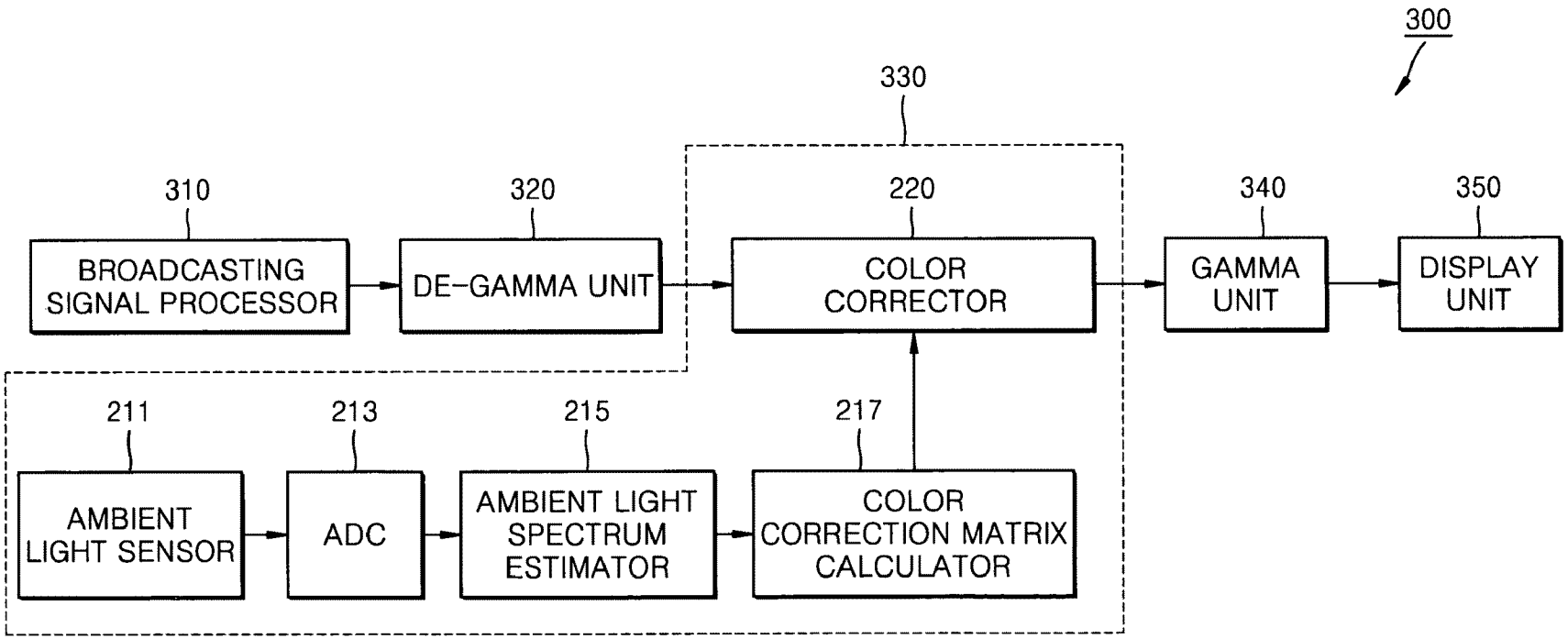
FIG. 3 is a block diagram of a system including the apparatus using ambient light as backlight according to an exemplary embodiment of the present invention.

FIG. 3 is a block diagram of a display system 300 having a broadcast receiving function, which includes the apparatus 330 using ambient light as backlight according to an exemplary embodiment of the present invention. Referring to FIG. 3, the display system 300 includes a broadcasting signal processor 310, a de-gamma unit 320, the apparatus 330 using ambient light as backlight, a gamma unit 340 and a display unit 350.

The broadcasting signal processor 310 processes a received broadcasting signal to generate nonlinear RGB signals. The configuration of the broadcasting signal processor 310 depends on the type of the broadcasting signal. In the case of a digital multimedia broadcasting signal, for example, the broadcasting signal processor 310 can include a tuner for tuning and demodulating a broadcasting signal inputted through a specific channel selected by a user to output a transport stream, a demultiplexer for demultiplexing the transport stream output from the tuner into a video transport stream and an audio transport stream, and a decoder for receiving the video transport stream and the audio transport stream and decoding them to output video and audio signals. The decoded signals can be generated as the nonlinear RGB signals.

The de-gamma unit 320 receives the nonlinear RGB signals and converts them into linear RGB signals.

The apparatus 330 using ambient light as backlight includes the color correction matrix generator 210 having the ambient light sensor 211, the analog-to-digital converter 213, the ambient light spectrum estimator 215 and the color correction matrix calculator 217, and a color corrector 220, as illustrated in FIG. 2, and generates the color correction matrix Mc. The apparatus 330 multiplies the color correction matrix Mc by the linear RGB signals output from the de-gamma unit 320 to correct colors.

The gamma unit 340 gamma-corrects the corrected RGB signals output from the color corrector 30. The display unit 350 displays the gamma-corrected RGB signals. A user can watch broadcasting programs with corrected colors using the apparatus 330 even when ambient light is changed.

Figure 7:
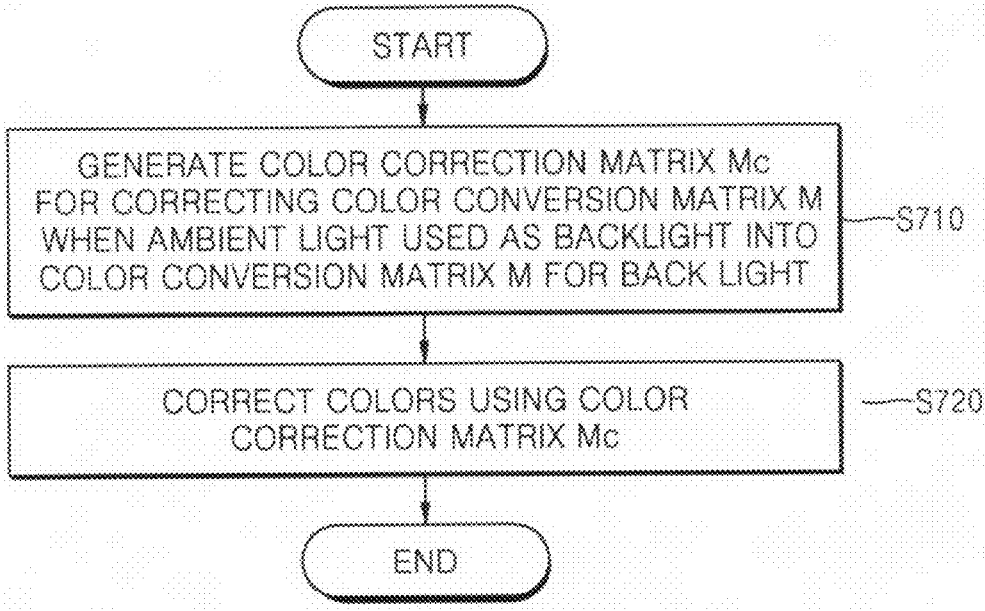
FIG. 7 is a flow chart of a color correcting method according to an exemplary embodiment of the present invention.

FIG. 7 is a flow chart of a color correcting method according to an exemplary embodiment of the present invention. The color correction matrix generator 210 of FIG. 2 generates the color correction matrix Mc for correcting the color conversion matrix M' when the ambient light is used as backlight into the color conversion matrix M for the original backlight in operation S710. To generate the color correction matrix Mc, the following method can be used.

First, ambient light is sensed and converted into a digital signal. The spectrum distribution of the ambient light is estimated using the digital signal and the color conversion matrix $M_{AMBIENT}$ is calculated using the estimated spectrum distribution. The color correction matrix Mc is calculated using the color conversion matrix $M_{AMBIENT}$ for the ambient light and the color conversion matrix M for the original backlight. The color correction matrix Mc can be generated by adding the color conversion matrix M to the color conversion matrix $M_{AMBIENT}$ to generate the color conversion matrix M' and multiplying the color conversion matrix M by the inverse matrix $M'^{-1}$ of the color conversion matrix M'.

The color corrector 220 corrects colors using the color correction matrix Mc in operation S720.

Figure 8:
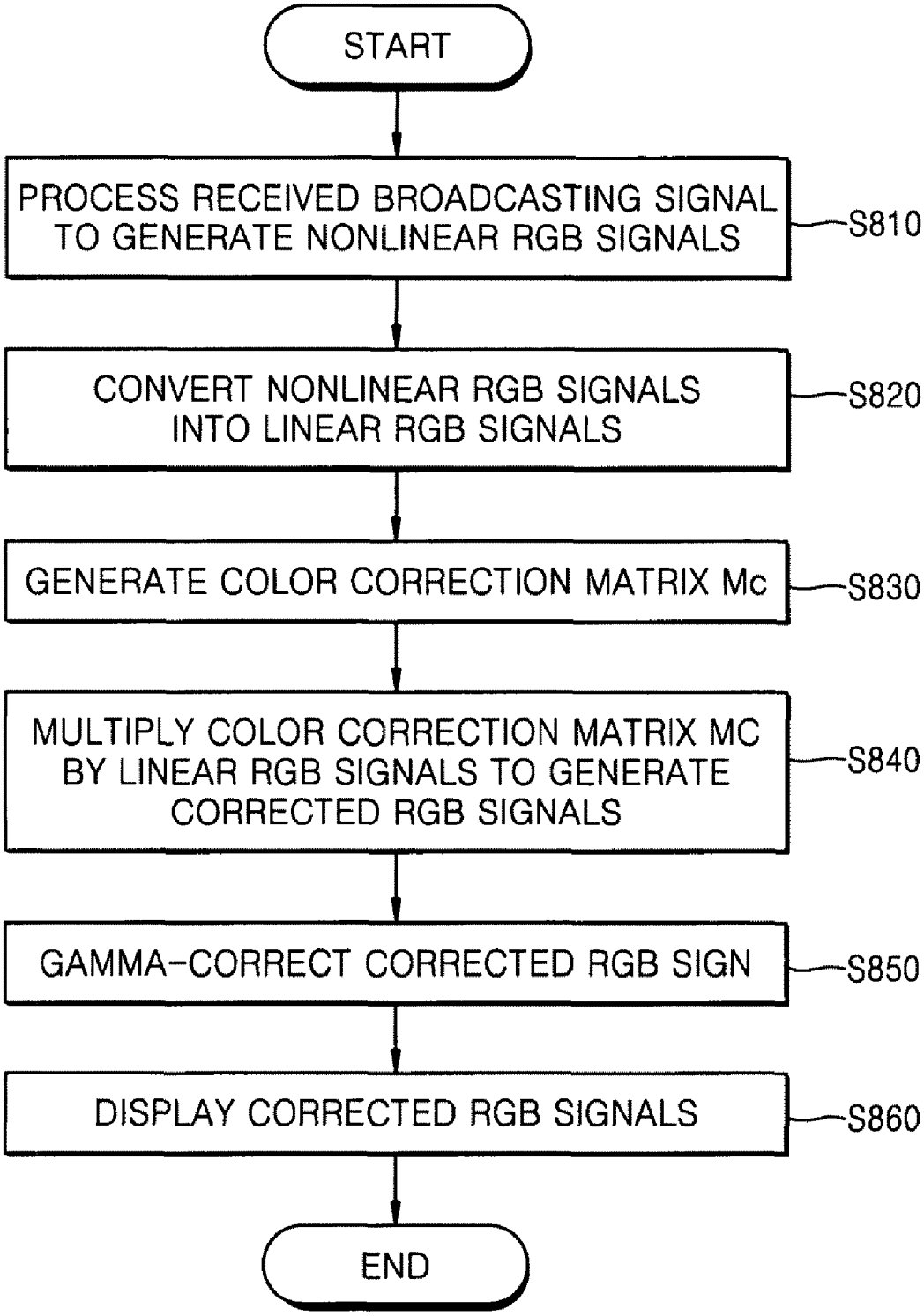
FIG. 8 is a flow chart of a color correcting method according to another exemplary embodiment of the present invention.

FIG. 8 is a flow chart of a color correcting method according to another exemplary embodiment of the present invention. Referring to FIG. 8, a received broadcasting signal is processed to generate nonlinear RGB signals in operation S810. The nonlinear RGB signals are converted into linear RGB signals in operation S820. The color correction matrix Mc for correcting the color conversion matrix M' when the ambient light is used as backlight into the color conversion matrix M for the original backlight is generated in operation S830. Operation 830 can be performed in parallel with operations S810 and S820.

The color correction matrix Mc is multiplied by the linear RGB signals to generate corrected RGB signals, thereby correcting colors in operation S840. The corrected RGB signals are gamma-corrected in operation S850. The gamma-corrected RGB signals are displayed on a display device in operation S860.

The present invention can also be embodied as computer readable code on a computer readable recording medium. The computer readable recording medium is any data storage device that can store data which can be thereafter read by a computer system. Examples of the computer readable recording medium include read-only memory (ROM), random-access memory (RAM), CD-ROMs, magnetic tapes, floppy disks, optical data storage devices, and carrier waves (such as data transmission through the Internet). The computer readable recording medium can also be distributed over network coupled computer systems so that the computer readable code is stored and executed in a distributed fashion.

As described above, according to the apparatus using ambient light as backlight and the method for correcting colors in the apparatus, color distortion, generated when ambient light used as backlight is changed, can be corrected.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An apparatus using ambient light as backlighting, the apparatus comprising:

a backlight unit that emits a backlight;

a reflecting unit that reflects the ambient light;

a color correction matrix generator that stores a third color conversion matrix, the third color conversion matrix converting RGB color signals into an XYZ color space when the backlighting includes only the backlight, and generates a first color correction matrix from a second color conversion matrix and the stored third color conversion matrix, the first color correction matrix correcting the RGB color signals when the backlighting includes the backlight and the ambient light, the second color conversion matrix converting the RGB color signals into the XYZ color space when the backlighting includes only the ambient light; and a color corrector which corrects the RGB color signals using the first color correction matrix.

2. The apparatus of claim 1, wherein the color correction matrix generator comprises:

an ambient light sensor which senses the ambient light;

an analog-to-digital converter which converts the sensed ambient light into a digital signal;

a spectrum estimator which estimates the spectrum distribution of the ambient light using the digital signal; and a color correction matrix calculator which calculates a fourth color conversion matrix, the fourth color conversion matrix converting the RGB space for the ambient light into an XYZ color space using the estimated spectrum distribution, and calculates the first color correction matrix using the fourth color conversion matrix and the third color conversion matrix.

3. The apparatus of claim 2, wherein the color correction matrix calculator adds the third color conversion matrix to the fourth color conversion matrix to obtain the second color conversion matrix and multiplies the third color conversion matrix by an inverse matrix of the second color conversion matrix to obtain the first color correction matrix.

4. The apparatus of claim 1, wherein color correction matrix generator stores the third color conversion matrix as a predetermined value.

5. The apparatus of claim 1, wherein the color corrector multiplies the first color correction matrix by the RGB signals to generate corrected RGB signals, and wherein the RGB signals are linear.

6. The apparatus of claim 2, wherein the ambient light sensor includes at least two sensors and converts the sensed ambient light into XYZ signals if one of the at least two sensors is not an XYZ sensor.

7. The apparatus of claim 1, further comprising:

a de-gamma unit which receives nonlinear RGB signals and converts the nonlinear RGB signals into linear RGB signals;

a gamma unit which gamma-corrects the corrected RGB signals output from the color corrector; and a display unit which displays the gamma-corrected RGB signals.

8. The apparatus of claim 7, further comprising a broadcasting signal processor which processes a received broadcasting signal to generate the nonlinear RGB signals.

9. A method for correcting colors in an apparatus using ambient light as backlighting, the method comprising:

storing a third color conversion matrix, the third color conversion matrix converting RGB color signals into an XYZ color space when the backlighting includes only the backlight;

generating a first color correction matrix from a second color conversion matrix and the stored third color conversion matrix, the first color correction matrix correcting the RGB color signals when the backlighting includes the backlight and the ambient light, the second color conversion matrix converting the RGB color signals into the XYZ color space when the backlighting includes only the ambient light; and correcting the RGB color signals using the first color correction matrix.

10. The method of claim 9, wherein the generating the first color correction matrix comprises:

sensing the ambient light;

converting the sensed ambient light into a digital signal;

estimating the spectrum distribution of the ambient light using the digital signal;

calculating a fourth color conversion matrix, the fourth color conversion matrix converting the RGB space for the ambient light into an XYZ color space using the estimated spectrum distribution; and calculating the first color correction matrix using the fourth color conversion matrix and the third color conversion matrix.

11. The method of claim 10, wherein the calculating the first color correction matrix comprises:

adding the third color conversion matrix to the fourth color conversion matrix to obtain the second color conversion matrix; and multiplying the third color conversion matrix by an inverse matrix of the second color conversion matrix to obtain the first color correction matrix.

12. The method of claim 9, wherein storing comprises storing the third color conversion matrix as a predetermined value.

13. The method of claim 9, wherein the correcting colors comprises multiplying the first color correction matrix by the RGB signals to generate corrected RGB signals, and wherein the RGB signals are linear.

14. The method of claim 10, wherein the sensing the ambient light further comprises converting the sensed ambient light into XYZ signals if the ambient light is sensed using a sensor other than an XYZ sensor.

15. The method of claim 9, further comprising:

receiving nonlinear RGB signals and converting the nonlinear RGB signals into linear RGB signals;

gamma-correcting the corrected RGB signals generated in the correcting colors; and displaying the gamma-corrected RGB signals.

16. The method of claim 15, further comprising processing a received broadcasting signal to generate the nonlinear RGB signals.

17. A computer readable recording medium storing a program for executing a method for correcting colors in an apparatus using ambient light as backlighting, the method comprising:

storing a third color conversion matrix, the third color conversion matrix converting RGB color signals into an XYZ color space when the backlighting includes only the backlight;

generating a first color correction matrix from a second color conversion matrix and the stored third color conversion matrix, the first color correction matrix correcting the RGB color signals when the backlighting includes the backlight and the ambient light, the second color conversion matrix converting the RGB color signals into the XYZ color space when the backlighting includes only the ambient light; and correcting the RGB color signals using the first color correction matrix.

* * * * *